US007092535B1

(12) United States Patent
Pedersen et al.

(10) Patent No.: US 7,092,535 B1
(45) Date of Patent: Aug. 15, 2006

(54) ENVIRONMENT ADAPTABLE LOUDSPEAKER

(75) Inventors: Jan Abildgaard Pedersen, Holstebro (DK); Ole Ploug, Struer (DK)

(73) Assignee: Bang & Olufsen A/S, (DK)

( * ) Notice: Subject to any disclaimer, the term of this patent is extended or adjusted under 35 U.S.C. 154(b) by 0 days.

(21) Appl. No.: 09/806,770

(22) PCT Filed: Oct. 6, 1999

(86) PCT No.: PCT/DK99/00528

§ 371 (c)(1),
(2), (4) Date: Apr. 3, 2001

(87) PCT Pub. No.: WO00/21331

PCT Pub. Date: Apr. 13, 2000

(30) Foreign Application Priority Data

Oct. 6, 1998 (DK) ..... 1998 01256

(51) Int. Cl.
*H04R 3/00* (2006.01)

(52) U.S. Cl. ..... 381/96; 381/56; 381/59

(58) Field of Classification Search ..... 381/56, 381/58, 59, 96

See application file for complete search history.

(56) References Cited

U.S. PATENT DOCUMENTS 5,729,611 A * 3/1998 Bonneville ..... 381/55
6,353,670 B1 * 3/2002 Gasner ..... 381/96
6,584,204 B1 * 6/2003 Al-Ali et al. ..... 381/96
6,807,279 B1 * 10/2004 Kyono ..... 381/96

* cited by examiner

*Primary Examiner*—Brian T. Pendleton
(74) *Attorney, Agent, or Firm*—Stites & Harbison PLLC; Marvin Petry

(57) ABSTRACT

It is known to make the performance of a loudspeaker "environment adaptive" in controlling a filter unit based on a measurement of the velocity/acceleration of the loudspeaker diaphragm and the associated sound pressure in front of the diaphragm, by means of an accelerometer and a microphone, respectively, thereby determining the radiation resistance of the diaphragm. The two sensors have to exhibit a constant transfer function throughout the life time of the loudspeaker, which make them very expensive. With the invention it has been found that the accelerometer can be replaced by another microphone held in a small distance from the diaphragm, and this conditions the possibility of using the same microphone for both measurements, e.g. simply by physically moving the microphone from one position to another. It will then no longer be required to use long-time stable sensors, whereby the price of the sensor equipment can be reduced dramatically. Also alternative arrangements are disclosed.

13 Claims, 1 Drawing Sheet

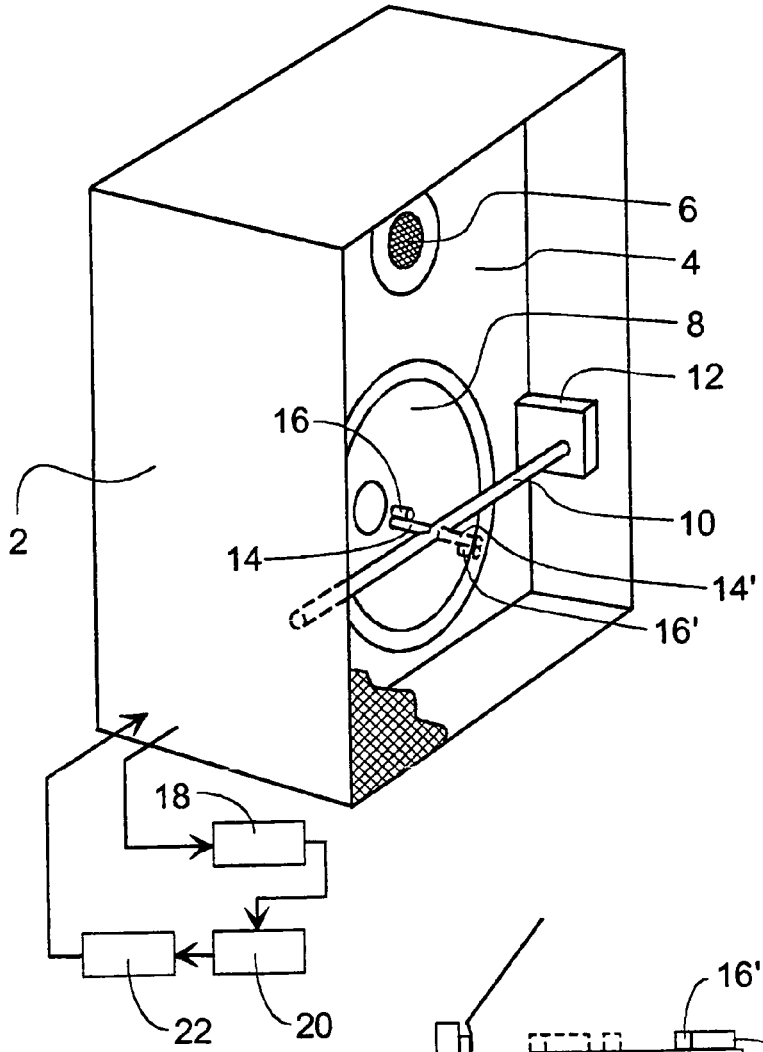
Fig.1
Fig.3
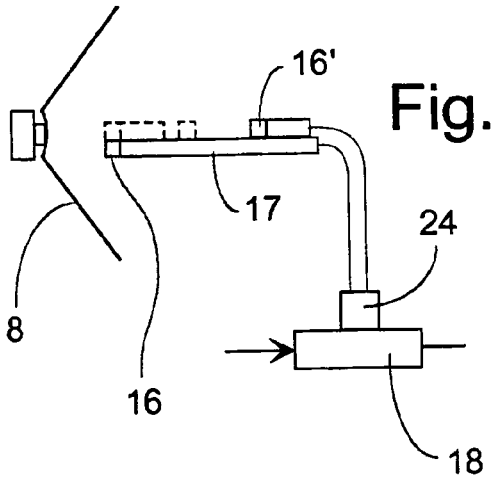
Fig.2
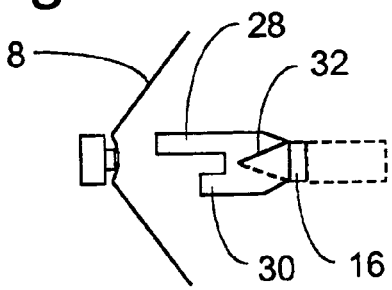
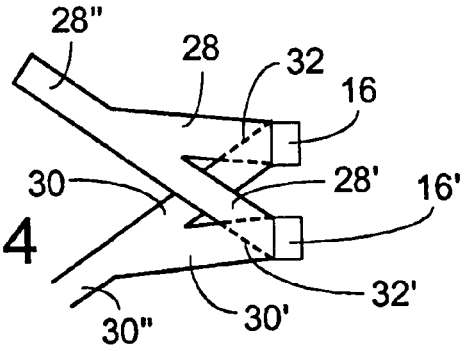
Fig.4
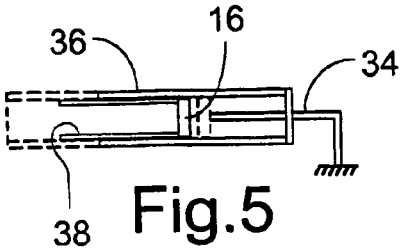
Fig.5

ENVIRONMENT ADAPTABLE LOUDSPEAKER

The present invention relates to a loudspeaker unit of the type having a detector system for measuring the radiation resistance of the loudspeaker diaphragm and for accordingly controlling the transfer characteristics of a correction filter in order to make the loudspeaker unit environment adaptive.

Such a system is known from WO84/00274, and it is used for adjusting the loudspeaker performance to high fidelity optimum all according to the "sound climate" of the room as seen from the loudspeaker diaphragm, i.e. also all according to the position and direction of the loudspeaker, the aim being to be able to control the acoustic power-output/frequency response in the listening room and to enable readjustment in case of acoustically major changes in the room.

The present invention has a similar aim, and is based on similar considerations as disclosed in the said WO document, so for further background information, reference can be made directly to that document.

In the known system the basic sensor equipment is an accelerometer mounted directly on the diaphragm and a microphone mounted slightly spaced in front of the diaphragm. These sensors will provide the signals required for the determination of the radiation resistance, provided, however, that each of the two sensors will always, i.e. throughout the operational lifetime of the loudspeaker, respond identically to identical signal inputs. Already rather small deviations of one of the sensors may disturb the original calibration significantly, and on this background it is required to use very expensive sensors that will remain stable over some 10–20 years.

According to the present invention it has been found that it is possible to determine the radiation resistance in another way, which is not exactly easier to perform, but can be performed by means of a sensor equipment, the price of which is dramatically reduced, even by a factor of some 500.

The basic consideration is that it is possible to determine changes of the radiation resistance based on a detection of the sound pressure in two (or more) points spaced different from the loudspeaker diaphragm, without using an accelerometer in direct connection with the diaphragm. For the relevant purpose it is not required to actually measure the absolute radiation resistance, as it is sufficient to obtain a reference value i.e. the absolute radiation resistance except for a scaling factor, for comparison with later detections of the sound pressures in the same two (or more) points.

According to a first approach it is possible to estimate the surface velocity of the diaphragm based on a measurement of the sound pressure in a point relatively close to the diaphragm and, based thereon, to determine the radiation resistance by measuring the sound pressure at another point, in which the sound amplitude is smaller than at the first point, i.e. a point further spaced from the diaphragm. If one of the positions is much closer to the diaphragm than the second position, then the acceleration (and in turn velocity) of the diaphragm can be estimated from the associated sound pressure, and the radiation resistance is proportional to the ratio between the second sound pressure and the respective first sound pressure.

According to another approach the said acceleration can be estimated from the difference between two measured sound pressures, without the closer position necessarily being very close to the diaphragm. The difference is 90 degrees out of phase with the velocity, i.e. in phase with the acceleration, because the real parts of the two sound pressures divided by the velocity are equal, as would have been the case for the sound pressures in any two points close to the diaphragm. The amplitude of the difference is proportional to the acceleration because reflections from the environment tend to contribute equally to the two sound pressures and therefore cancels when calculating the difference.

Both of these approaches imply the use of two measurements by the same type of sensor, viz. microphones, and according to the invention this opens for the possibility of using but a single sensor for effecting both of the required measurements, viz. when these are made in a successive manner with a single microphone physically responding to the air pressures in the respective two positions. This will be a matter of changing the microphone position within a time interval of a few minutes only, and it can be assumed realistically that during this lapse of time the microphone will not change its transfer function significantly. If a new measurement is made e.g. three years later it will be without importance whether the transfer function of the sensor has undergone a change in the meantime, since what matters will, still be that this function is unchanged during the few minutes required for the new measurement.

An alternative will be to use a single microphone which is stationarily positioned at one end of one or two sound guiding tubes having their free ends located at the respective different positions, with associated valve means for selectively connecting the microphone acoustically with the respective positions.

The above measures will account for the use of a sensor which is not at all supposed to behave in a stable manner year after year, and accordingly the associated costs of such sensors may be drastically reduced as already mentioned.

In practice an alternative will be the use of two cheap microphone units which are arranged so as to be interchangeable between two opposed positions, one relatively close to the diaphragm, e.g. a few centimeters therefrom, and one some centimeters further away. Two microphones can also be used in the way that one measurement is made with the microphones correspondingly interspaced and another measurement with the microphones moved closely together, whereby it is possible to conduct a separate calibration and thus make the first measurement of two sound pressures reliable for the determination of the radiation resistance. Of course, measurements may be made in more than two positions for refining the result.

It has been demonstrated in practice that the estimation of the diaphragm velocity based on a measurement of the sound pressures is sufficiently representative for the present purpose, provided the sound pressures are measured at distances which are short compared to the wave length, e.g. shorter than ⅛ of the wave length.

In the following the invention is described with reference to the drawing, in which FIG. 1 is a perspective view of a loudspeaker unit according to an embodiment of the invention, FIG. 2 is a schematic lateral view of a modified loudspeaker, and FIGS. 3–5 are similar views of further modifications.

The unit shown in FIG. 1 comprises a box 2 with a mounting plate 4 for a tweeter 6 and a woofer 8.

In front of the woofer a cross bar 10 is mounted, extending from a motor housing 12 having means for rotating the bar 10 through 180°. Outside the center of the woofer 8 the bar 10 has a branch rod 14 carrying at its outer end a small microphone 16, which will thus be rotatable between a position facing the woofer, and as shown at 16', an inverted position further spaced from the woofer.

As explained above, by a detection of the sound pressure in first one and then the other of these two positions of the microphone it is possible, in a unit 18, to calculate the radiation resistance of the woofer diaphragm, and then to apply a corresponding control signal to a filter unit 20 arranged in the signal line to the loudspeaker unit, preferably before the amplifier 22. The filter 20 is relevant only for the performance of the woofer, while a similar system could be advantageous for correspondingly controlling e.g. a mid-range loudspeaker.

An adjustment of the filter 20 could be effected automatically at regular intervals or even in response to detection of an apparent change of the radiation resistance; the unit 18 will then get the opportunity to make sure whether the change is real or only owing to drift of the microphone. Preferably, however the loudspeaker or the reproduction set including the loudspeaker is provided with a control button to be actuated by the user whenever changes are brought about in the room acoustics.

Alternatively, the parts indicated 14' and 16' could be real parts, i.e. with 16' representing an additional microphone positioned symmetrically with the microphone 16 with respect to the axis of the rod 10, such that the two microphones can be swapped between the same two positions, and then enable relative calibrations of the two microphones.

Still a further alternative, which is illustrated in FIG. 2, is to arrange one of these microphones, 16, stationarily in one of the two positions and provide for the other microphone 16' to be shiftable between the two positions, in close proximity with the first microphone in the common position of the two microphones. The microphone 16' may hereby be slidably arranged along a support 17. Some lateral spacing may be acceptable in the common position, but the distance to the diaphragm should be substantially the same. In this system the microphones should be connected to a calibration unit 24 associated with the processing unit 18, for calibration when the microphones assume the common position.

Alternatively, the support 17 may carry both microphones 16 and 16' in a slidable or otherwise shiftable manner such that they can be swapped between the respective two positions, e.g. by a translatoric movement along the support 17, in order to enable double relative calibration of the microphones, just as when two microphones are used in the system shown in FIG. 1.

A still further alternative is illustrated in FIG. 3. A single microphone 16 is mounted in connection with a housing 26 having two tubes 28 and 30 pointing towards the diaphragm 8, the housing 26 holding a switch valve plate 32 that can be switched over so as to connect the microphone 16 with either one or the other tube. The sound pressure detected by the microphone will be representative of the sound pressure at the open end of the respective tube, inasfar as the sound will not be further spread by its passage through the tube. The sound waves create a pumping effect which is transmitted through the tube. For that sake, such a tube may extend even in the opposite direction as shown at 32 in dotted lines. At the relevant low frequency range the microphones will be omnidirectional. However, even if a microphone is not fully omnidirectional, the only consequence will be that it will not detect the sound pressure directly at the tube end, but somewhat spaced therefrom, thus still measuring the pressure "in a second position". When only the measuring conditions are unchanged over time, then the measuring results will still be representative for the relevant purpose.

FIG. 4, by way of example, shows a modification of the system shown in FIG. 3. Two stationary microphones 16 and 16' are used, each acoustically connectable with two tubes 28, 30 and 28', 30', respectively, through respective switch over valves 32 and 32'. The two tube pairs 28, 28' and 30, 30' merge into respective common tubes 28" and 30" having free ends located differently spaced from the diaphragm. By operating the valve plates 32, 32' suitable, it is possible to connect one microphone (16 or 16') with the pipe 28" and at the same time connect the other microphone with the tube 30", whereafter these connections can be swapped for a new measurement. The effect will be identical with the physical swapping of two microphones as mentioned in connection with FIG. 1, though now without requiring the microphones to be located differently spaced from the diaphragm. They should not either necessarily be equally spaced therefrom, as the said relative calibrations will be achievable anyhow, given that the two microphones are exposed to the same sound signal during each of the measurements. Only the amplitude or sound pressure of the signal will be different, given by the respective positions of the free ends of the tubes 28" and 30".

A further modification is illustrated in FIG. 5, showing a stationary microphone 16 held by a carrier arm 34 and surrounded by a sleeve member 36, which is operable to be displaced from a retracted position, in which its free end is located behind the microphone 16 or behind the outer end of a tube portion 38 projecting forwardly therefrom, to a projected position in front of the microphone or its associated tube 38. Already by this measure it will be ascertained that the required two measurements be made by different sound pressures, whereby it is not necessary to arrange for a displacement of the microphone itself.

Alternatively, the tube 38 may be a flexible hose, the free end of which is positionable in respective fixtures in well defined positions differently spaced from the diaphragm.

The invention is not limited to the use of only one or two microphones, or to the use of only two measuring positions.

For further explanation with respect to the physics and mathematics of the invention reference is made to the Danish patent application No. 1256/58, from which priority is claimed; the files of that application were made accessible to the public by May 10, 1999.

As additional background disclosure, reference can be made to the Japanese patent Application no. JP 09233593 A, published by May 9, 1997.

The invention claimed is:

1. A loudspeaker comprising:

a sensor for the determination of the radiation resistance of a diaphragm, the radiation resistance expressed by the velocity/acceleration of the loudspeaker diaphragm and the sound pressure in a distance from the diaphragm, and thereby, via a signal processing unit, provide a control signal to a filter unit adjusting the performance of the loudspeaker in an adaptive manner to the acoustical characteristics of the listening room, said sensor comprising a microphone for detecting the sound pressure in at least two points differently spaced from the diaphragm;

a carrier means enabling the microphone to be effectively and successively exposed to the sound pressure in each of the at least two points; and in which the microphone is mounted in a stationary position and is acoustically connected with a sound guide tube having a free end located spaced from the diaphragm, said tubes being telescopically or otherwise adjustably arranged so as to enable its free end to be shiftable between positions differently spaced from the diaphragm.

2. A loudspeaker, comprising:

a sensor for the determination of the radiation resistance of a diaphragm, the radiation resistance expressed by the velocity/acceleration of the loudspeaker diaphragm and the sound pressure in a distance from the diaphragm, and thereby, via a signal processing unit, provide a control signal to a filter unit adjusting the performance of the loudspeaker in an adaptive manner to the acoustical characteristics of the listening room, said sensor comprising a microphone for detecting the sound pressure in at least two points differently spaced from the diaphragm;

a carrier means enabling the microphone to be effectively and successively exposed to the sound pressure in each of the at least two points; and in which the sound pressure is detected in a first point relatively close to the diaphragm, and in a second point further spaced from the diaphragm, and in which the signal processing unit operates to calculate the real part of the product of j (square root of minus 1) and the ratio between the sound pressures in the second and the first point, respectively.

3. A loudspeaker according to claim 2, in which the carrier means are operable to shift the microphone between said two points.

4. A loudspeaker according to claim 3, in which the carrier means are rotatable.

5. A loudspeaker according to claim 3, in which a position of the microphone is shiftable by a translatoric displacement.

6. A loudspeaker according to claim 2, in which the microphone is mounted in a stationary position and operatively coupled to the diaphragm through tube means having free ends located at positions differently spaced from the diaphragm, valve means being provided for acoustically connecting the microphone selectively with either of said free ends.

7. A loudspeaker according to claim 2, in which the microphones is shiftable between three or more different positions differently spaced from the loudspeaker diaphragm.

8. A loudspeaker, comprising:

a sensor for the determination of the radiation resistance of a diaphragm, the radiation resistance expressed by the velocity/acceleration of the loudspeaker diaphragm and the sound pressure in a distance from the diaphragm, and thereby, via a signal processing unit, provide a control signal to a filter unit adjusting the performance of the loudspeaker in an adaptive manner to the acoustical characteristics of the listening room, said sensor comprising a microphone for detecting the sound pressure in at least two points differently spaced from the diaphragm;

a carrier means enabling the microphone to be effectively and successively exposed to the sound pressure in each of the at least two points; and in which the sound pressure is detected in two points differently spaced from the diaphragm, and in which the signal processing unit operates to calculate the real part of the product of j (square root of minus 1) and the ratio between a sound pressure P and the difference between the sound pressure in said first and second points, P being either one of the two measured pressures or an average of the two measured pressures.

9. A loudspeaker according to claim 8, in which the carrier means are operable to shift the microphone between said two points.

10. A loudspeaker according to claim 9, in which the carrier means are rotatable.

11. A loudspeaker according to claim 9, in which a position of the microphone is shiftable by a translatoric displacement.

12. A loudspeaker according to claim 8, in which the microphone is mounted in a stationary position and operatively coupled to the diaphragm through tube means having free ends located at positions differently spaced from the diaphragm, valve means being provided for acoustically connecting the microphone selectively with either of said free ends.

13. A loudspeaker according to claim 8, in which the microphone is shiftable between three or more different positions differently spaced from the loudspeaker diaphragm.

* * * * *